US006206608B1

(12) United States Patent
Blevins

(10) Patent No.: US 6,206,608 B1
(45) Date of Patent: Mar. 27, 2001

(54) VEHICLE DISABLING DEVICE

(76) Inventor: Jerry L. Blevins, 109 Farm Hill Dr., Toms Brook, VA (US) 22660

( * ) Notice: Subject to any disclaimer, the term of this patent is extended or adjusted under 35 U.S.C. 154(b) by 0 days.

(21) Appl. No.: 09/330,984

(22) Filed: Jun. 14, 1999

(51) Int. Cl.[7] ..... E01F 13/00; E01F 15/00
(52) U.S. Cl. ..... 404/6
(58) Field of Search ..... 404/6; 256/13.1

(56) References Cited

U.S. PATENT DOCUMENTS

| | | | | |
|---|---|---|---|---|
| 4,382,714 | | 5/1983 | Hutchison . | |
| 4,995,756 | | 2/1991 | Kilgrow et al. . | |
| 5,123,774 | * | 6/1992 | Dubiel | 404/6 |
| 5,253,950 | | 10/1993 | Kilgrow et al. . | |
| 5,328,292 | | 7/1994 | Williams . | |
| 5,507,588 | * | 4/1996 | Marts et al. | 404/6 |
| 5,611,408 | * | 3/1997 | Abukhader | 180/287 |
| 5,704,445 | | 1/1998 | Jones . | |

* cited by examiner

*Primary Examiner*—Thomas B. Will
*Assistant Examiner*—Gary S. Hartmann
(74) *Attorney, Agent, or Firm*—Hoffman Wasson & Gitler PC

(57) ABSTRACT

A vehicle disabling device has a solid steel bar with pairs of chains extending therefrom. Extending between the two chains of a pair are bases provided with spikes. When a vehicle engages the device, the spikes puncture the tire and are retained in the tire. This causes the chains to become wrapped around the tire as the vehicles extends forward towards the bar. When the car reaches the end of the device, the bar is caused to be taken up by the chains. The bar engages the frame of the vehicle and presents a hindrance to the rotation of the tires and the steering of the vehicle.

11 Claims, 4 Drawing Sheets

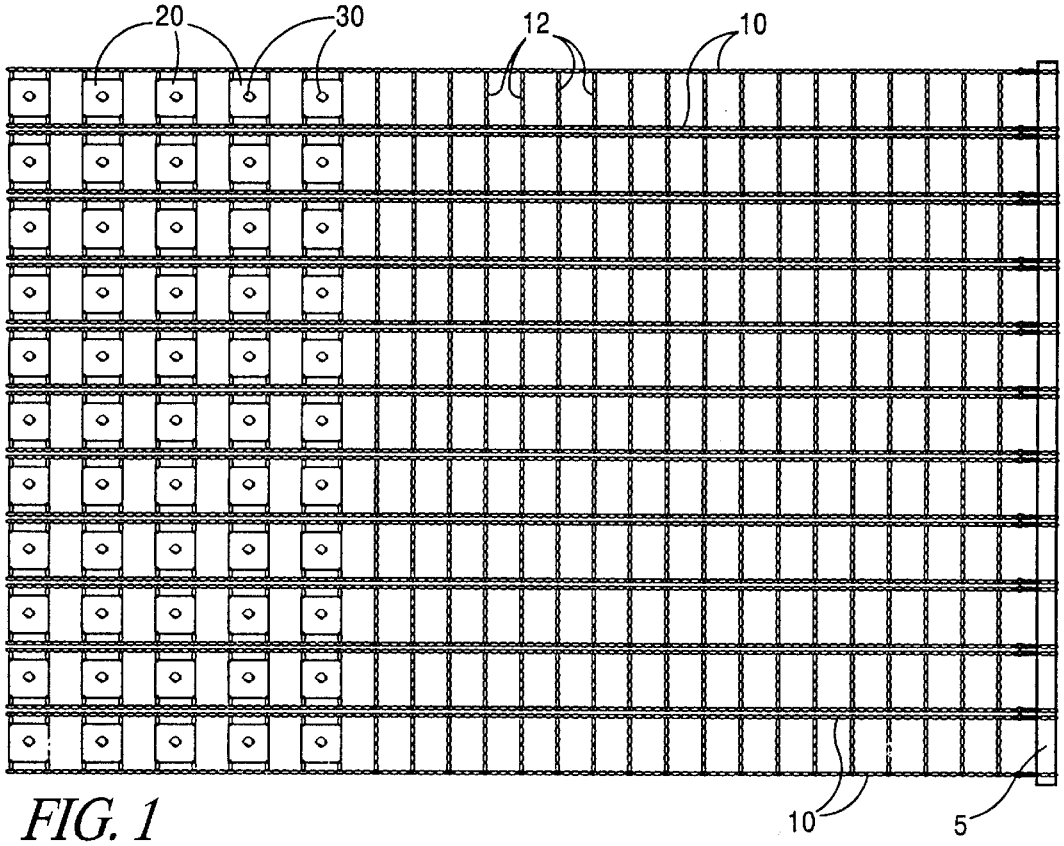
FIG. 1
FIG. 2
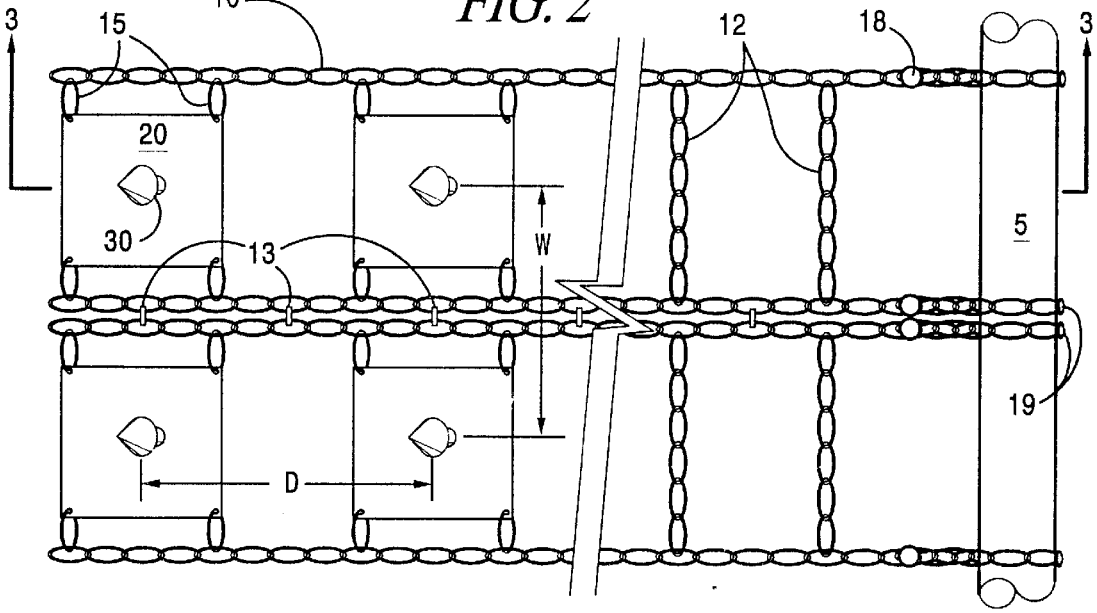

FIG. 3
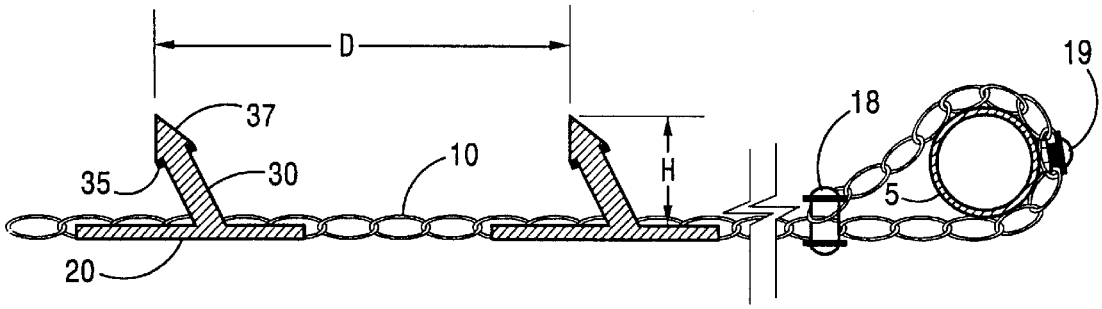
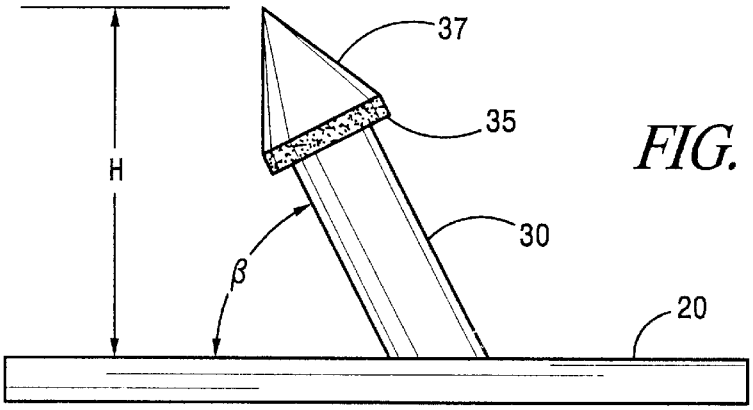
FIG. 4
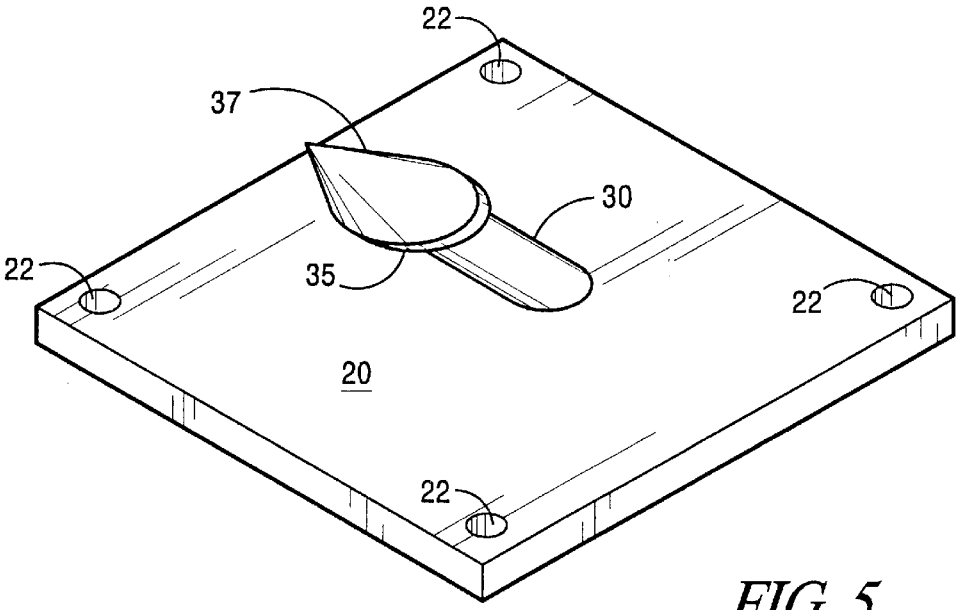
FIG. 5

VEHICLE DISABLING DEVICE

FIELD OF THE INVENTION

The invention is a device to disable vehicles.

BACKGROUND OF THE INVENTION

Police are often encountered with a situation where they need to stop a vehicle. During high speed pursuits, the driver attempts to escape capture and flees the police. The driver, concerned only with escape, often drives recklessly and endangers himself and other drivers on the road. Police are faced with the problem of trying to stop the driver without damage and loss of life.

Police have many techniques to stop run-away drivers. The police utilize road blocks and pursuit by car and helicopter to pursue reckless drivers in the hope that they will eventually abandon the vehicle and attempt to escape on foot. Police often use spikes to deflate tires. Spikes are usually effective in causing the tire to deflate, but often desperate drivers continue to drive on the flattened tires. This results in loss of control of the vehicle and the creation of sparks as the rim contacts the pavement. This only serves to increase the danger presented by the person trying to flee.

The prior art discloses many different types of tire deflators that are designed to disable motor vehicles. U.S. Pat. No. 5,704,445, to Jones, discloses a base 12 that holds spikes 24 at an angle of 45 to 85° relative to the top surface of the base. The spike is held within an aperture 22 of the base and is designed to be released from the base and transferred to the tire after becoming embedded in the tire. The spikes are hollow and provide a conduit for the escape of air.

U.S. Pat. No. 4,995,756 (Killgrow et al) discloses a vehicle tire deflator having an extensible frame having rocker arms 12 provided with hollow spikes. The rocker arms are pivotally connected to one another by supports 11. A series of rocker arms are connected to one another to provide a series of rows of spikes. A tire rolls over the deflator and the spike is withdrawn from the rocker arm. A similar device is discloses in U.S. Pat. No. 5,253,950, also to Killgrow et al.

U.S. Pat. No. 5,328,292, to Williams, discloses a traffic barrier chain having a pair of spikes connected in an X-shape and connected to one another by a chain to form a row. A similar device is disclosed in U.S. Pat. No. 4,382,714 to Hutchison that has a spike 20 connected to a base 11. The base 11 is provided with a chain 18. The chain is used to connected adjacent deflators, but is provided with a break-away cord or strand.

It is an object of the invention to provide a vehicle disabling device that deflates the tires.

It is another object of the invention to provide a vehicle disabling device that provides obstruction to the free movement of the wheels.

It is still another object of the invention to provide a disabling device that is easily stored and deployed.

It is a further object of the invention to provide a vehicle disabling device that is easily manufactured.

These and other objects of the invention will be apparent after reading the ensuing disclosure.

SUMMARY OF THE INVENTION

The invention is a solid bar having a series of chains that extend perpendicular to the length of the bar. The chains are provided in pairs and connected to one another. At the distal end of the chains, bases are connected between the two chains of a pair. The bases are provided with upstanding spikes. A series of bases having the spikes extend between the pairs of chains for a predetermined distance. Between the bar and the closest spike, cross chains are used to maintain the spacing between the chains.

The device is placed on the road so that the vehicle to be stopped first engages the front end having the spikes. The spikes embed into the tire and are maintained there. As the car continues moving across the device, the subsequent spikes also are embedded into the tire and result in the chains being wrapped around the tire. The connection between the pairs of spikes is broken and each pair of chains acts independently. If the car continues across the device, the chains continue to wrap around the tire. At the end of the device, the solid bar is pulled upward and locks itself against the frame of the car. This prevents the wheels from rotating and interferes with the steering of the car. In this manner, the car is safely and quickly brought to a halt.

BRIEF DESCRIPTION OF THE DRAWINGS

FIG. 1 is a top view of the device in it's deployed condition;

FIG. 2 is a detailed view of two pairs of chains;

FIG. 3 is a cross-sectional view along line 3—3 of FIG. 2;

FIG. 4 is a side view of a base and spike;

FIG. 5 is a perspective view of a base and spike;

DETAILED DESCRIPTION OF THE INVENTION

Figure 6A:
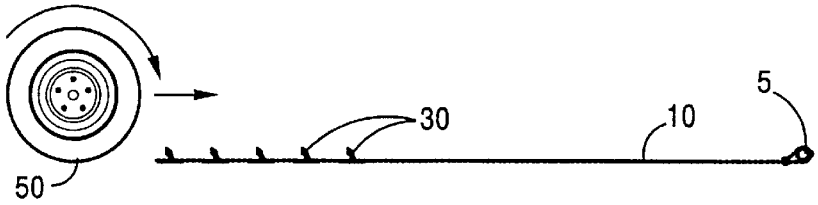
FIGS. 6A through 6E show the sequence of events as a tire rolls over the device and the spikes are retained by the tire.
Figure 6B:
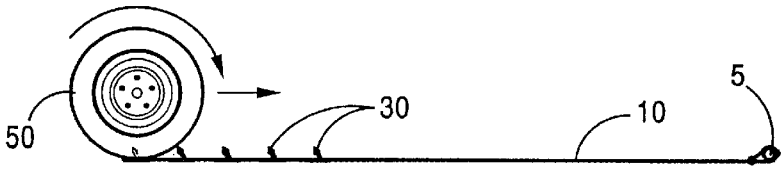
Figure 6C:
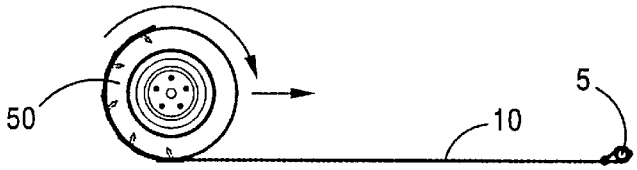

The vehicle disabling device is seen in the top view depicted in FIG. 1. The device has a rear edge formed by a solid bar 5. Extending from the bar 5 is a series of main chains 10 that terminate at the front edge of the device. It is so denoted the front edge because it is the edge that a vehicle to be disabled first encounters. The main chains 10 are provided in pairs. At the front edge of the device, a series of bases 20, each provided with a spike 30, is provided between each pair of main chains 10. The extend from the front edge that the spikes extend is a function of the size of tire on the vehicle to be disabled. As will be explained hereinafter, the distance from the front edge of the device to the last spike should not be greater than the circumference of the vehicle's tire. For instance, on a typical sized tire for a passenger car is 14 inches. For this reason, the last spike should not be greater than 44 inches from the front edge of the device. The 44 inches represents the circumference of the 14 inch tire. For the extent of the main chains between the last spike and the bar, a series of cross chains 12 is provided between the two main chains of a pair. The cross chains serve to maintain the spacing between the main chains 12 and keep them parallel to one another.

The details of the arrangement between the various components that comprise the device is seen in FIG. 2. Two pairs of the main chains are illustrated. As can be seen, the bar 5 has the main chains 12 secured to it in a manner to be described later. The chains extend parallel to one another and perpendicular to the bar. The two main chains 10 of the pair are connected by cross chains 12 or the bases 20. The bases 20 are connected to the main chains 10 by retaining links 15. The adjacent main chains 10 of the two pair are connected to one another by break-away clips 13. The distance D between the two spikes varies one to eight inches and the width between the spikes of adjacent pairs are likewise separated by a distance of one to eight inches.

A cross section of the device can be seen in FIG. 3.

In this view, one can see that the base 20 and spike 30 are formed as one piece. The spike 30 has a point 37 provided with a base 35. The main chains 10 are connected to the bar in two ways. First, the chain is wrapped or extends around the bar 5 and the end of the chain is connected to another section of chain by a chain link 18. Also, a pin 19 extends through a chain link and is attached to the bar 5. These two methods of securing the main chains 10 to the bar 5 result in a strong connection between the bar 5 and chain 10. Any method of connecting the chain to the bar can be used. It is only necessary that the connection be strong enough to withstand the impact to be described later.

The details of the base and spike are clearly shown in FIG. 4. The spike 30 creates an angle β with the base 20. The angle β is in the range of 45 to 80°. The height of the spike point 37 to the base is between one and three inches. FIG. 5 shows a perspective view of the base and spike. In this view, the apertures 22 that are used to connect the base to the main chain 10 by the retaining link 16 are shown. In the base depicted, there is one aperture 22 in each corner of the base.

The operation of the device is shown in the sequences depicted in FIGS. 6A through 6E. The period immediately prior to the engagement of a vehicle tire with the device is shown in FIG. A. As can be seen, the tire is approaching the front end and therefore will engage the spikes. The spikes are angled toward the front edge in order to create a better angle with the tire when the spike contacts the tire. Figures B shows the vehicle tire as it first engages the device. In this figure, it is seen how the forward tilt of the spike creates a near perpendicular relationship between the surface of the tire and the spike itself. This allows for easy penetration of the spike into the tire.

FIG. 3 shows the full engagement of all the spikes with the tire. The spikes are retained in the tire and cause the chains to become wrapped around the tire. In this figure, it is clear that as the tire completes one revolution on the device, there will be no further spikes to engage the tire. This is because spikes are no longer necessary. The spikes have already served their function of puncturing the tire to cause the tire to deflate and cause the device to be retained onto the tire. It is not necessary for the tire to deflate, as long as the spikes serve to retain the chain onto the tire. The device will prevent the vehicle from further forward motion. As explained earlier, the pairs of main chains are connected to one another by break-away links 13. As the device is taken up by the vehicle, only those chains that have spikes embedded in the tire will be taken up. The other chains will remain on the ground and are not needed for the device to function properly.

Figure 6D:
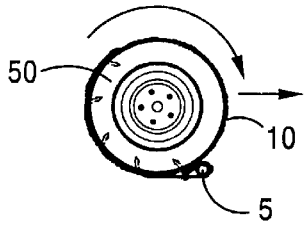
Figure 6E:
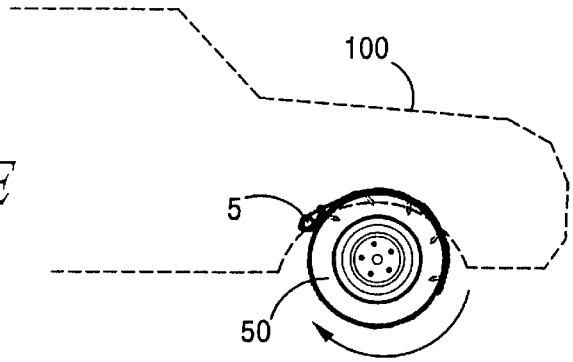

FIG. 6D shows the tire 50 as it reaches the edge of the device. As can be seen, the chains 10 have continued to wrap around the tire and the spikes are still retained with the tire. The bar 5 is now underneath the tire and its function will become apparent with references to FIG. 6E. Turning to this figure, it is seen how the continued rotation of the tire causes the bar to get carried up by the tire into the wheel well of the vehicle. In the best scenario, both front tires of the vehicle have been engaged by the device and therefore both front tires are now wrapped by chains. This will cause the bar to extend across the full width of the vehicle. Even if engaged by only one tire, the bar will be brought up and contact the frame of the vehicle. The bar is made of a rigid material, such as steel, and contact of the bar with the vehicle frame will serve to both prevent rotation of the tire and make steering of the vehicle extremely difficult.

Figure 7A:
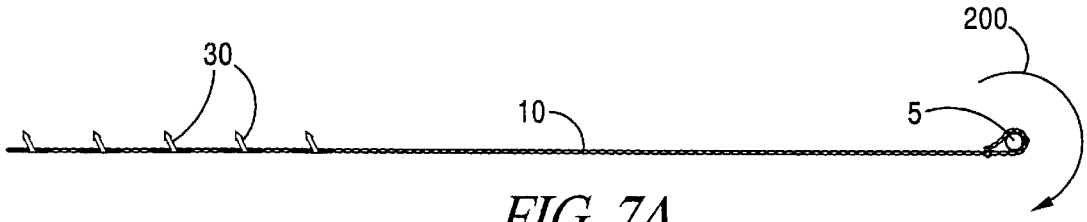
FIGS. 7A through 7D show the sequence of steps rolling the device for storage.
Figure 7B:
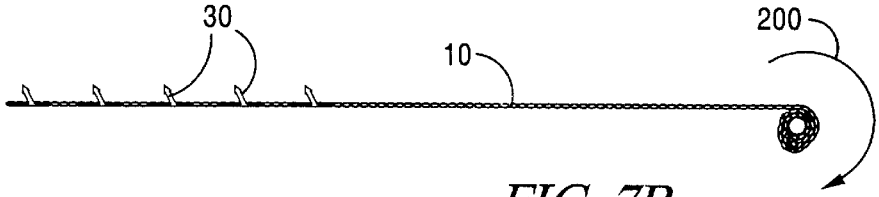
Figure 7C:
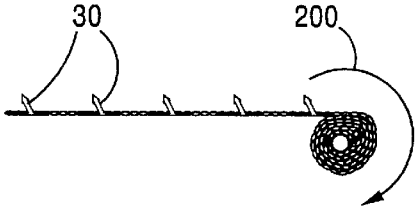
Figure 7D:
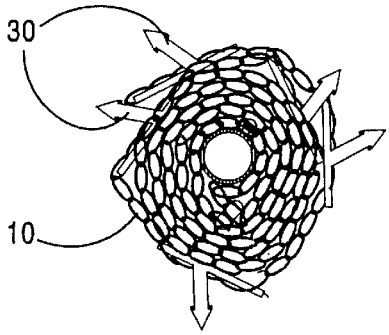

The storage of the device, for storage of transportation, is shown in FIGS. 7A through 7D. The device is rolled from the rear edge with the bar being rolled onto the bottom surface of the device as shown in FIG. 7A. The device is continued to be rolled as shown in FIGS. 7B and 7C. By rolling along the bottom edge, the spikes do not interfere with the portions of the chain already rolled. They extend outwards on the outer edge of the roll as shown in FIG. 7D. In this manner, the device can be easily stored or transported for deployment when needed.

The device has been described with reference to a preferred embodiment, but various modifications and variations would be obvious to one of ordinary skill in the art and the description of the preferred embodiment is not intended to be limited.

I claim:

1. A vehicle disabling device comprising:

a bar having a longitudinal axis;

said bar forming a rear edge of the device;

a plurality of chains connected to and extending from the bar along its longitudinal axis said chains extending in a forwardly direction; and spikes for puncturing a vehicle's tire connected to said chains and spaced from said bar, said spikes extending upward.

2. The vehicle disabling device of claim 1, wherein said chains extend from said bar and are perpendicular thereto.

3. The vehicle disabling device of claim 1, wherein said chains are provided in pairs.

4. The vehicle disabling device of claim 3, wherein said pairs of chains are connected together by break-away clips.

5. The vehicle disabling device of claim 3, wherein said spikes extend upwardly from bases, each base connected to one of said pairs of chains.

6. The vehicle disabling device of claim 3, further comprising cross chains extending between said chains in said pair for maintaining the chains parallel to one another.

7. The vehicle disabling device of claim 1, wherein said bar is steel.

8. The vehicle disabling device of claim 1, wherein said spikes extend upward at an angle of 45 to 80° and have a height of one to three inches.

9. The vehicle disabling device of claim 1, wherein said spikes extend upwardly from bases, each base connected to two chains.

10. A method of disabling a vehicle comprising:

providing a vehicle disabling device, said vehicle disabling device comprising:

a bar for engagement with a vehicle underside, said bar forming a rear edge, chains connected to and extending from said bar, spikes for puncturing a vehicle's tire extending upward from said chains, said vehicle running over said device, said spikes puncturing said tire and retained in said tire, wrapping said chains around said vehicle tire by the continued movement of said vehicle over the device in a direction of said bar, and engaging said bar on the underside of the vehicle by said bar being carried upward after the vehicle continues over said bar.

11. A vehicle disabling device comprising:

a bar;

said bar forming a rear edge of the device;

a plurality of chains having a first end and a second end connected to and extending from said bar; and spikes for puncturing a vehicle's tire connected to and spaced along each of said chains between said first and second ends, said spikes spaced from said bar and extending upward.

* * * * *